US006498615B1

(12) United States Patent
Chwalek et al.

(10) Patent No.: US 6,498,615 B1
(45) Date of Patent: Dec. 24, 2002

(54) INK PRINTING WITH VARIABLE DROP VOLUME SEPARATION

(75) Inventors: James Michael Chwalek, Pittsford, NY (US); John Andrew Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 662 days.

(21) Appl. No.: 08/918,474

(22) Filed: Aug. 26, 1997

(51) Int. Cl.[7] ..... B41J 2/05
(52) U.S. Cl. ..... 347/56
(58) Field of Search ..... 347/48, 62, 63, 347/15, 56

(56) References Cited

U.S. PATENT DOCUMENTS

| | | | |
|---|---|---|---|
| 3,946,398 | A | 3/1976 | Kyser et al. |
| 4,882,595 | A | 11/1989 | Trueba et al. |
| 5,036,337 | A | 7/1991 | Rezanka |

FOREIGN PATENT DOCUMENTS

| | | | |
|---|---|---|---|
| EP | 0 747224 | A1 | 12/1996 |
| WO | WO 96/32289 | | 10/1996 |

OTHER PUBLICATIONS

Hawley's Condensed Chemical Dictionary, Richard Lewis, Sr., pp. 1066–1067, 1997.*

* cited by examiner

*Primary Examiner*—John Barlow
*Assistant Examiner*—Michael S Brooke
(74) *Attorney, Agent, or Firm*—Milton S. Sales

(57) ABSTRACT

An ink drop ejecting printhead includes a substrate having an ink drop emitting opening; a heater on the substrate surrounding the opening; and an ink supply communicating with the opening to supply ink, whose surface tension decreases inversely with its temperature, to the opening under positive pressure relative to ambient. A variable-energy electrical power supply connected to the heater, whereby application of an electrical pulse of sufficient energy to the heater will cause separation of an associated ink drop from the ink supply. A power supply control is adapted to regulate the energy of electrical pulses applied to the heater from the power supply, whereby the volumes of separated ink drops are proportional to the energy of the associated electrical pulses.

9 Claims, 4 Drawing Sheets

INK PRINTING WITH VARIABLE DROP VOLUME SEPARATION

CROSS REFERENCE TO RELATED APPLICATIONS

Reference is made to Commonly assigned U.S. Pat. No. 5,880,759, entitled A LIQUID INK PRINTING APPARATUS AND SYSTEM filed in the name of Kia Silverbrook on Dec. 3, 1996; and to Commonly assigned U.S. Pat. No. 6,022,099, entitled INK PRINTING WITH DROP SEPARATION filed in the names of James M. Chwalek and John A. Lebens on Jan. 21, 1997.

FIELD OF THE INVENTION

This invention relates generally to the field of digitally controlled printing devices, and in particular to liquid ink drop-on-demand printheads which integrate multiple nozzles on a single substrate and in which a poised liquid meniscus on a nozzle is expanded to a pre-determined volume and is separated for printing by thermal activation. Furthermore, the volume separated drop may be controlled to permit continuous toning and grayscale toning of images.

BACKGROUND OF THE INVENTION

Ink jet printing has become a preferred technology for the printing of color images. The term "ink jet" as used herein is intended to include all drop-on-demand or continuous ink jet propulsion systems including, but not limited to, bubble jet, thermal ink jet, piezoelectric and continuous.

There are two types of drop-on-demand ink jet printers that dominate the market. Drop-on-demand thermal ink jet printers operate by rapidly heating a small volume of ink, causing it to vaporize and expand, thereby ejecting ink through an orifice or nozzle and causing it to land on selected areas of a recording medium. The sequenced operation of an array of such orifices moving past a recording medium writes a dot pattern of ink on the recording medium, forming text or pictorial images. The print head typically includes an ink reservoir and channels to replenish the ink to the region in which vaporization occurs. An arrangement of thermal ink jet heaters, ink channels, and nozzles is disclosed in U.S. Pat. No. 4,882,595.

The drop-on-demand piezoelectric printers operate by using a separate piezoelectric transducer for each nozzle generating a pressure pulse to expel the drops. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Color rendition is accomplished by adding a few (typically three) color ink reservoirs and associated nozzles and ejection means so that dots of different colors may be overlaid on an appropriate recording medium.

The above methods as practiced suffer from drawbacks, notable the difficulty of achieving continuous tone (grayscale) color reproduction. One method used to provide continuous tone color reproduction, namely the deposition of multiple drops with the same volume onto a single image pixel, allows only a limited number of gray levels corresponding to the number of drops deposited. The volume of ink drops has also been controlled in piezoelectric drop-on-demand printers by varying the applied energy, such as by adjusting the pulse height or pulse width of the applied electrical signal. This method tends to allow only a small volume variation and exhibits a drop velocity variation with size, making placement difficult on the recording medium.

Commonly assigned co-pending U.S. patent applications Ser. No. 08/750,438 entitled A LIQUID INK PRINTING APPARATUS AND SYSTEM filed in the name of Kia Silverbrook on Dec. 3, 1996, discloses a liquid printing system that affords significant improvements toward overcoming the prior art problems associated with power usage, durability, thermal stresses, other printer performance characteristics, manufacturability, and characteristics of useful inks. The invention provides a drop-on-demand printing mechanism wherein the means of selecting drops to be printed is by thermal reduction of the surface tension of the selected drop producing a difference in position between selected drops and drops which are not selected but which is insufficient to cause the ink drops to overcome the ink surface tension and separate from the body of ink, and wherein an additional means is provided to cause separation of the selected drops from the body of ink. To cause separation of the drop the system requires either proximity mode, for which the recording medium must be in close proximity to the orifice in order to separate the drop from the orifice, or the use of an electric field between recording medium and orifice. A drop volume adjustment can be made, for example in proximity mode, by altering the distance between print head and recording medium which requires increased system complexity.

Commonly assigned co-pending U.S. patent application Ser. No. 08/787,657 entitled INK PRINTING WITH DROP SEPARATION filed in the names of James M. Chwalek and John A. Lebens on Jan. 21, 1997, discloses a printing system where by the separation of the selected drop is achieved by controlled thermal activation propelling it to the recording medium without the need for proximity or an electric field.

DISCLOSURE OF THE INVENTION

It is an object of the present invention to improve upon the above invention by demonstrating a new mode of operation. This mode, which was not previously predicted, permits control of the separated drop volume for continuous toning and gray scale toning of images. A volume change of at least a factor of 3 can be obtained with only a small change in drop velocity.

It is another object of the present invention to demonstrate a new mode of operation for a drop-on-demand printhead wherein electrothermal pulses applied to an annular heater located around the rim of a nozzle controls the expansion of a poised meniscus, the separation of the drop, and the volume of the separated drop, propelling it to the recording medium. Electrothermal pulses applied to selected nozzles heat the ink in those nozzles, altering material properties of the ink, including a reduction in the surface tension of the ink and causing it to expand past its initially poised state. Heating the ink adjacent to the heater surface to a temperature greater than its boiling point results in separation of the drop. By controlling the heating, a pre-determined drop volume may be delivered to the recording medium. This pre-determined drop volume may consist of more than one drop ejected as a result of a singly-applied electrothermal pulse.

According to a feature of the present invention, an ink drop ejecting printhead includes a substrate having an ink drop emitting opening; a heater on the substrate surrounding the opening; and an ink supply communicating with the opening to supply ink, whose surface tension decreases inversely with its temperature, to the opening under positive pressure relative to ambient. A variable-energy electrical power supply connected to the heater, whereby application of an electrical pulse of sufficient energy to the heater will cause separation of an associated ink drop from the ink supply. A power supply control is adapted to regulate the energy of electrical pulses applied to the heater from the power supply, whereby the volumes of separated ink drops are proportional to the energy of the associated electrical pulses.

According to another feature of the present invention, a process for ejecting ink from a printhead includes the steps of communicating an ink supply, whose surface tension decreases inversely with its temperature, with an ink-emitting opening to supply ink to the opening; applying positive pressure relative to ambient to the ink supply; adjustably applying pulses of heat to the ink at the opening of sufficient energy to cause separation of associated ink drops from the ink supply; and variably adjusting the applied heat pulse energy, whereby the volume of the separated ink drops are proportional to the energy of associated heat pulses.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1(*b*) shows a cross section of the nozzle tip in accordance with the present invention.

FIG. 1(*c*) shows a top view of the nozzle tip in accordance with the present invention.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
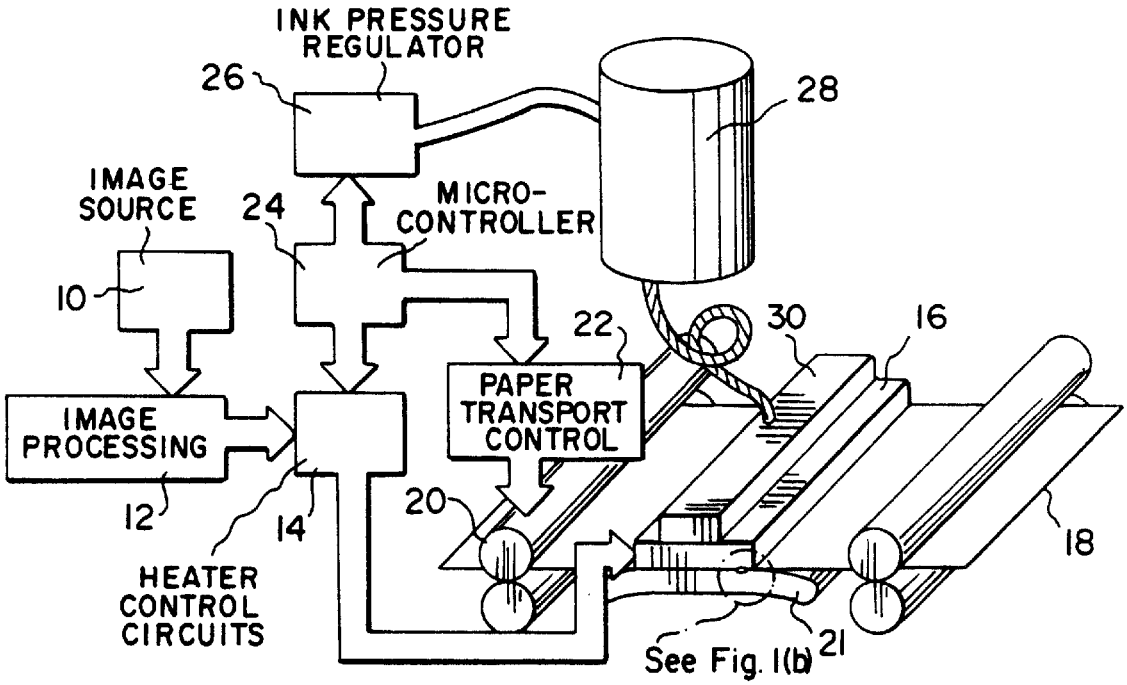
FIG. 1(*a*) shows a simplified block schematic diagram of one exemplary printing apparatus in which the present invention is useful.
Figure 1B:
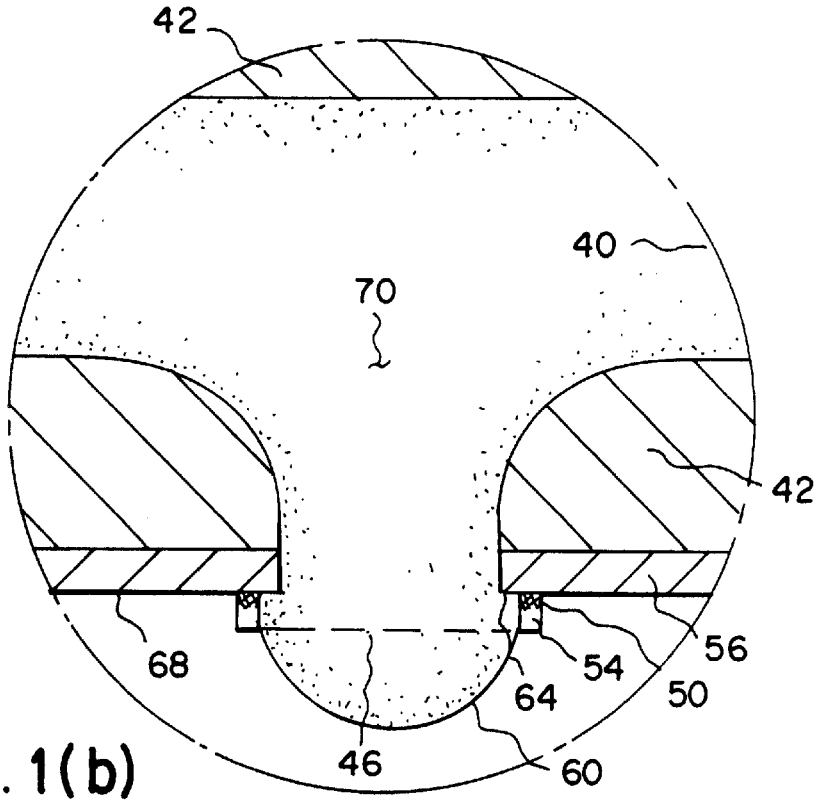
Figure 1C:
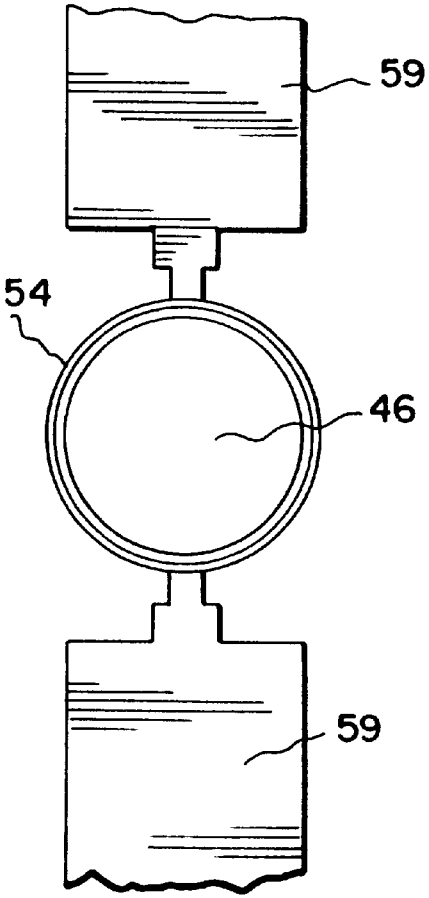

FIG. 1(*a*) is a drawing of a drop-on-demand ink jet printer system utilizing the ink jet head with drop separation means. An image source 10 may be raster image data from a scanner or computer, or outline image data in the form of a page description language, or other forms of digital image representation. This image data is converted to half-toned bitmap image data by an image processing unit 12 which also stores the image data in memory. Heater control circuits 14 read data from the image memory and apply time-varying electrical pulses to the nozzle heaters that are part of a printhead 16. These pulses are applied at an appropriate time, and to the appropriate nozzle, so that selected drops will form spots on a recording medium 18 in the appropriate position designated by the data in the image memory. Optimal operation refers to an operating state whereby ink drops are separated and ejected from one or more pressurized nozzle orifices by the application of electrical pulses to the heater surrounding the nozzle without the need for an external drop separation means.

Recording medium 18 is moved relative to printhead 16 by a recording medium transport system 20, which is electronically controlled by a recording medium transport control system 22, which in turn is controlled by a micro-controller 24. A recording medium guide or platen 21 is shown directly below printhead 16. The recording medium transport system shown in FIG. 1(*a*) is schematic only, and many different mechanical configurations are possible. In an alternative embodiment, a transfer roller could be used in place of the recording medium transport system 20 to facilitate transfer of the ink drops to recording medium 18. Such transfer roller technology is well known in the art. In the case of page width printheads, it is most convenient to move recording medium 18 past a stationary printhead 16. However, in the case of scanning print systems, it is usually most convenient to move printhead 16 along one axis (the sub-scanning direction) and recording medium 18 along the orthogonal axis (the main scanning direction), in a relative raster motion.

Micro-controller 24 may also control an ink pressure regulator 26 and heater control circuits 14. Ink is contained in an ink reservoir 28 under pressure. In the quiescent state (with no ink drop ejected), the ink pressure is insufficient to overcome the ink surface tension and eject a drop. The ink pressure for optimal operation will depend mainly on the nozzle orifice diameter, surface properties (such as the degree of hydrophobicity) of a bore 46 and a rim 54 of the nozzle, surface tension of the ink, and power as well as temporal profile of the heater pulse. A constant ink pressure can be achieved by applying pressure to ink reservoir 28 under the control of ink pressure regulator 26. Alternatively, for larger printing systems, the ink pressure can be very accurately generated and controlled by situating the top surface of the ink in reservoir 28 an appropriate distance above printhead 16. This ink level can be regulated by a simple float valve (not shown). The ink is distributed to the back surface of printhead 16 by an ink channel device 30. The ink preferably flows through slots and/or holes etched through the silicon substrate of printhead 16 to the front surface, where the nozzles and heaters are situated.

FIG. 1(*b*) is a detail enlargement of a cross-sectional view of a single nozzle tip of the drop-on-demand ink jet printhead 16 according to a preferred embodiment of the present invention. An ink delivery channel 40, along with a plurality of nozzle bores 46 are etched in a substrate 42, which is silicon in this example. In this example, delivery channel 40 and nozzle bore 46 were formed by anisotropic wet etching of silicon, using a $p^+$ etch stop layer to form the shape of nozzle bore 46. Ink 70 in delivery channel 40 is pressurized above atmospheric pressure, and forms a meniscus 60 which protrudes somewhat above nozzle rim 54, at a point where the force of surface tension, which tends to hold the drop in, balances the force of the ink pressure, which tends to push the drop out.

In this example, the nozzle is of cylindrical form, with heater 50 forming an annulus. The heater is made of polysilicon doped at a level of about thirty ohms/square, although other resistive heater material could be used. Nozzle rim 54 is formed on top of heater 50 to provide a contact point for meniscus 60. The width of the nozzle rim in this example is from about 0.6 $\mu$m to about 0.8 $\mu$m. Heater 50 is separated from substrate 42 by thermal and electrical insulating layers 56 to minimize heat loss to the substrate.

The layers in contact with the ink can be passivated with a thin film layer 64 for protection, which can also include a layer to improve wetting of the nozzle with the ink in order to improve refill time. The printhead surface can be coated with a hydrophobizing layer 68 to prevent accidental spread of the ink across the front of the printhead. The top of nozzle rim 54 may also be coated with a protective layer which could be either hydrophobic or hydrophillic.

FIG. 1(*c*) is an enlargement of a top view of a single nozzle of drop-on-demand ink jet printhead 16 according to a preferred embodiment of the present invention. Nozzle rim 54 and heater annulus 50 located directly under nozzle rim 54 surrounds the periphery of nozzle bore 46. A pair of power and ground connections 59 from the drive circuitry to heater annulus 50 are shown, and are fabricated to lie in the heater plane below the nozzle rim.

Heater control circuits 14 supply electrical power to the heater for a given time duration. Optimum operation provides a sharp rise in temperature at the start of the heater pulse, a maintenance of the temperature above the boiling point of the ink in an annular volume just to the ingress of the nozzle/heater interface for part of the duration of the heater pulse, and a rapid fall in temperature at the end of the heater pulse. The heater pulse controls the expansion of a poised meniscus, the separation of the drop, and the volume of the separated drop. The power and duration of the applied heater pulse that is necessary to accomplish this depends mainly on the geometry and thermal properties (such as thermal conductivity, specific heat, and density) of the materials in and around the heater including the thermal properties of the ink as well as the surface tension and viscosity of the ink. Thermal models can be used to guide the selection of geometrical parameters and materials as well as operating ranges of the ink pressure, heater pulse power and duration. It is recognized that a certain degree of experimentation may be necessary to achieve the optimal conditions for a given geometry.

For small drop sizes, gravitational force on the ink drop is very small; approximately $10^{-4}$ of the surface tension forces, so gravity can be ignored in most cases. This allows printhead 16 and recording medium 18 to be oriented in any direction in relation to the local gravitational field. This is an important requirement for portable printers.

Figure 2:
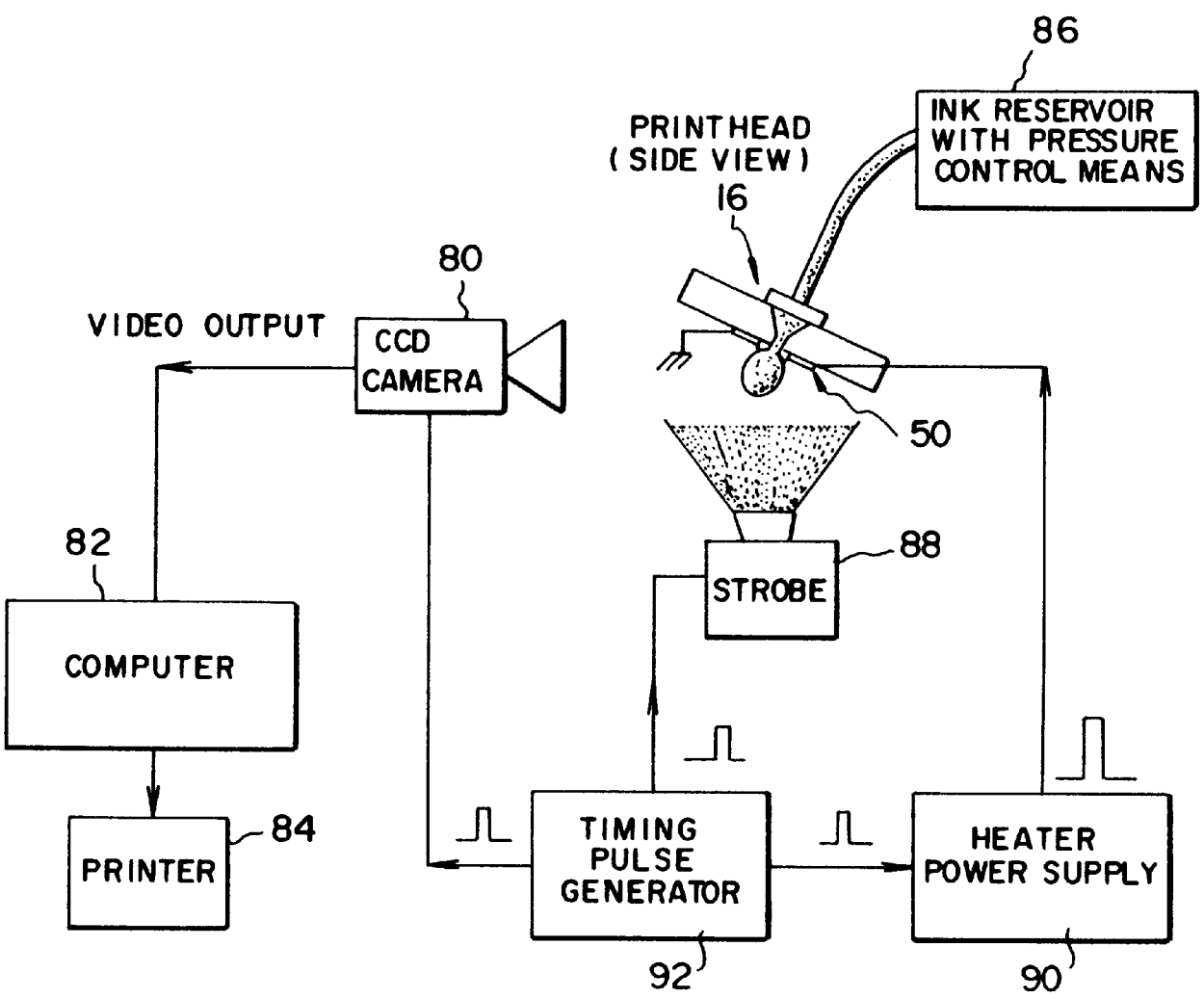
FIG. 2 shows a simplified block schematic diagram of the experimental setup used to test the present invention.

The ink jet head with drop separation means shown schematically in FIGS. 1(*b*) and 1(*c*) was fabricated as described above and experimentally tested. A schematic diagram of the experimental set up used to image drops emitted from printhead 16 is shown in FIG. 2. A CCD camera 80 connected to a computer 82 and printer 84 was used to record images of the drop at various delay times relative to the heating pulse. Printhead 16 was angled at thirty degrees from the horizontal so that the entire heater 50 could be viewed. Because of the reflective nature of the surface, a reflected image of the drop appeared together with the imaged drop. An ink reservoir and pressure control means 86, shown as one unit, was included to poise the ink meniscus at a point below the threshold of ink release. A fast strobe 88 was used to freeze the image of the drop in motion. A heater power supply 90 was used to provide a current pulse to heater 50. Strobe 88, camera 80, and heater power supply 90 may be synchronously triggered by a timing pulse generator 92. In this way, the time delay between strobe 88 and heater power supply 90 may be set to capture the drop at various points during its formation.

EXPERIMENTAL RESULTS

Figures 3A, 3B, 3C, 3D, 3E:
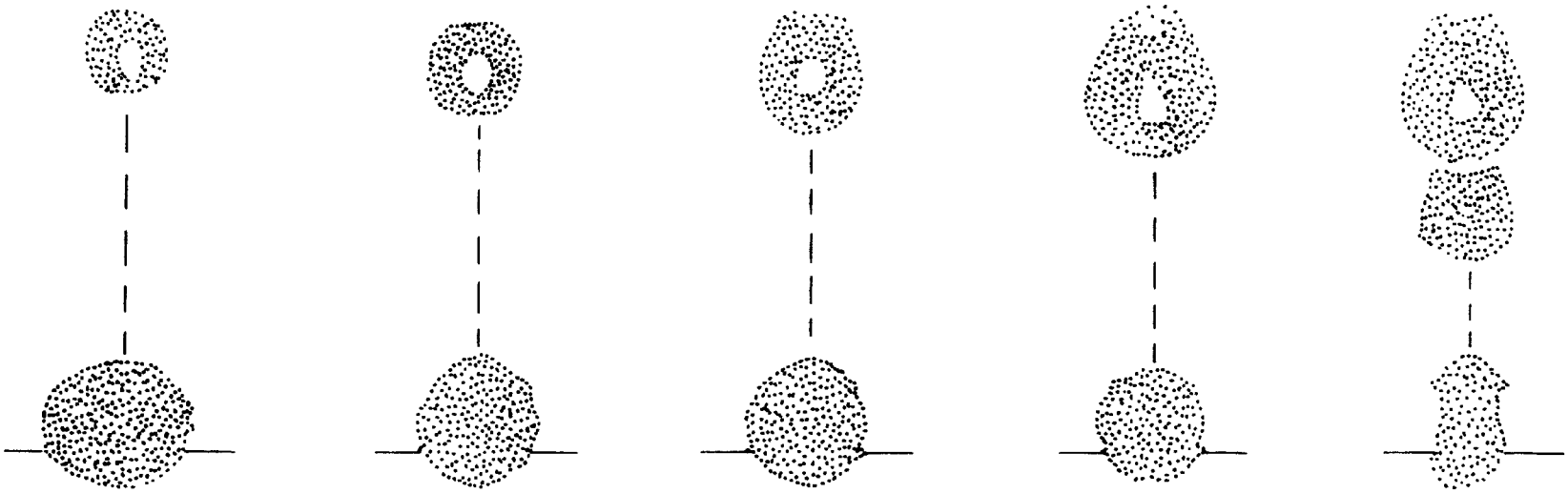
FIGS. 3(*a*) to 3(*e*) shows the variation in separated drop volume in accordance with the present invention.

A 16 $\mu$m diameter nozzle, fabricated as described above and shown schematically in FIGS. 1(*b*) and 1(*c*), was mounted in the test setup shown schematically in FIG. 2. The nozzle reservoir was filled with de-ionized water and pressurized to a pressure of 13.2 kPa, below the measured critical pressure of 17.0 kPa. The nozzle contained a hydrophobizing Teflon® layer. FIG. 3(*a*) is an image of a separated drop taken 220 $\mu$s after the start of a 70 $\mu$s duration, 115 mW electrical pulse applied to heater 50. The application of the thermal energy to the de-ionized water in the nozzle has changed some of the physical properties of the de-ionized water, including decreasing its surface tension and viscosity. The result is a separated drop whose volume may be controlled by the electrical pulse applied to heater. Note that the image is taken at a tilt of thirty degrees from horizontal with a reflected image of the poised meniscus also appearing. For pulse durations below 65 $\mu$s separation of the de-ionized water from the nozzle did not occur. FIGS. 3(*b*)–3(*d*) are images of separated drops taken 220 $\mu$s after the start of 100, 130, and 160 $\mu$s duration, 115 mW electrical pulses applied to heater 50. As can be seen from FIG. 3, the size and hence volume of the drop is increasing with the duration of the heater pulse. In FIG. 3(*e*), two drops are separated with the application of a 200 $\mu$s duration electrical pulse.

Figure 4:
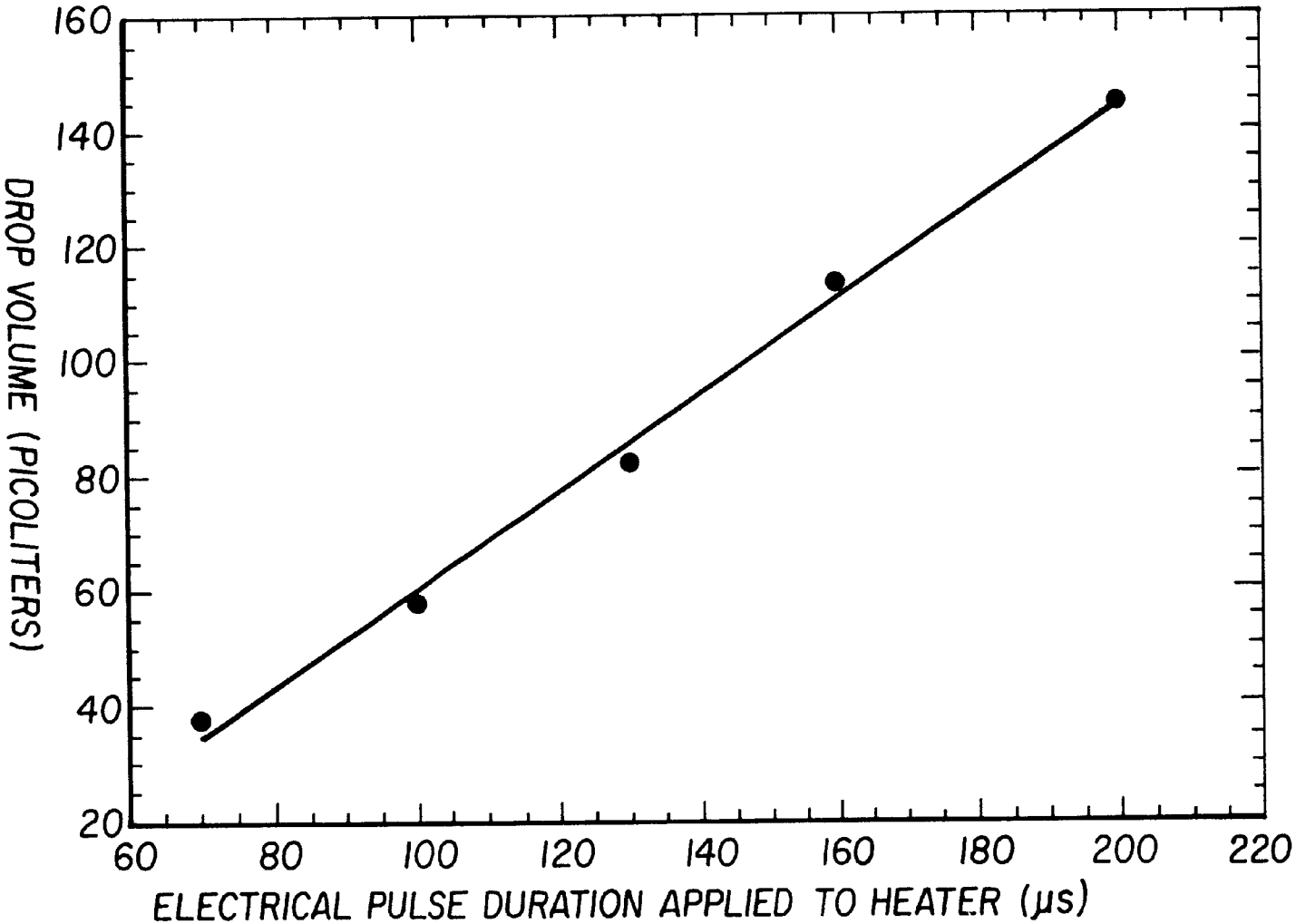
FIG. 4 shows the relationship between heater pulse duration and separated drop volume in accordance with the present invention.

In FIG. 4, the drop volume computed from the drop images of FIG. 3 is plotted against the duration of the electrical pulse applied to heater. The line through the data points is a linear least squares fit. As can be seen from FIG. 4, the drop volume is proportional to the duration of the electrical pulse applied to heater even when more than one drop is produced from a single electrical pulse. With the ability to control drop volume in such a manner, continuous toning and grayscale toning of images is possible.

The invention has been described in detail with particular reference to preferred embodiments thereof, but it will be understood that variations and modifications can be effected within the spirit and scope of the invention.

What is claimed is:

1. An ink drop ejecting printhead comprising:

a substrate having an ink drop emitting opening;

a heater on the substrate surrounding the opening;

an ink supply communicating with the opening to supply ink, whose surface tension varies inversely with its temperature, to the opening under positive pressure relative to ambient pressure;

a variable-energy electrical power supply connected to the heater, whereby application of an electrical pulse of sufficient energy to the heater will cause separation of an associated ink drop from the ink supply; and a power supply control adapted to regulate the energy of electrical pulses applied to the heater from the power supply, whereby the volumes of separated ink drops are proportional to the energy of the associated electrical pulses.

2. An ink ejecting printhead as set forth in claim 1 wherein the volumes of separated ink drops are proportional to the duration of the associated electrical pulses.

3. An ink ejecting printhead as set forth in claim 1 wherein the opening and the heater are annular.

4. An ink ejecting printhead as set forth in claim 1 wherein the power supply is adapted to apply an electrical pulse of sufficient energy to heat ink adjacent to the heater to a temperature greater than its boiling point, thereby causing separation of ink from the ink supply.

5. An ink ejecting printhead as set forth in claim 1 wherein the heater is made at least in part of polysilicon doped at a level of about thirty ohms/square.

6. An ink ejecting printhead as set forth in claim 1 further comprising a thermal and electrical insulating layer separating said substrate and the heater.

7. A process for ejecting ink from a printhead, said process comprising:

communicating an ink supply, whose surface tension varies inversely with its temperature, with an ink-emitting opening to supply ink to the opening;

applying positive pressure relative to ambient pressure to the ink supply;

adjustably applying pulses of heat to the ink at the opening of sufficient energy to cause separation of associated ink drops from the ink supply; and variably adjusting the applied heat pulse energy, whereby the volume of the separated ink drops are proportional to the energy of associated heat pulses.

8. A process as set forth in claim 7 wherein the energy of the heat pulses is adjusted by adjusting the duration of the heat pulses.

9. A process as set forth in claim 7 wherein the heat pulse applying step is sufficient to heat the ink to a temperature greater than its boiling point, thereby causing separation of ink drops from the ink supply.

* * * * *